United States Patent [19]

Fawley

[11] 4,332,331

[45] Jun. 1, 1982

[54] ROTATABLE VALVE PROTECTOR FOR COMPRESSED GAS CYLINDER

[76] Inventor: Norman C. Fawley, 255 Rafael Walk, Long Beach, Calif. 90803

[21] Appl. No.: 156,181

[22] Filed: Jun. 3, 1980

[51] Int. Cl.[3] ..... B65D 25/00

[52] U.S. Cl. ..... 220/85 P; 137/382; 222/182

[58] Field of Search ..... 220/85 P, 69, 71, 73; 222/182; 137/372, 377, 382

[56] References Cited

U.S. PATENT DOCUMENTS

| | | | |
|---|---|---|---|
| 2,234,458 | 3/1941 | Underhill . | |
| 3,006,360 | 10/1961 | Oxenham | 220/85 P |
| 3,035,605 | 5/1962 | Ninneit | 220/85 P |
| 3,476,288 | 11/1969 | Sherrill . | |
| 3,648,885 | 3/1972 | Kitsada . | |
| 3,776,412 | 12/1973 | Mink . | |
| 4,103,806 | 8/1978 | White . | |

*Primary Examiner*—George E. Lowrance

*Attorney, Agent, or Firm*—Marvin A. Naigur; John E. Wilson; Warren B. Kice

[57] ABSTRACT

A rotatable valve protector for a compressed gas cylinder having a neck to which a valve is attached. The valve protector comprises a rigid, hollow, open-ended, generally frustoconical element having large lateral openings affording access to the valve and enabling the use of the protector as a handle for the cylinder. The valve protector is rotatably mounted so that the access openings may be oriented in any direction without movement of the cylinder. In addition, the cylinder can be tipped and supported at the neck by the rotatable protector while the bottom of the cylinder is rolled along a supporting surface.

10 Claims, 8 Drawing Figures

ROTATABLE VALVE PROTECTOR FOR COMPRESSED GAS CYLINDER

BACKGROUND OF THE INVENTION

This invention relates to a valve protector for a compressed gas cylinder, and more particularly to a rotatable valve protector which is readily secured to a compressed gas container and easily removable therefrom.

Metal-walled cylinders are widely employed for containing gas under pressure, and such cylinders are commonly provided at one end with a neck on which is mounted a valve or other instrumentality to effect controlled release of the contained gas. Merely by way of example, cylinders of this type are used to hold industrial and welding gases, as well as gaseous carbon dioxide for the carbonation of beverages.

Because of their smooth, elongated shape and considerable weight of approximately 140 lbs., such cylinders are inconvenient to handle. Moreover, the exposed, projecting valve on such cylinders is vulnerable to misadjustment or damage, either by impacts with objects or hard surfaces incident to the handling of the cylinder, or by blow from moving objects when the cylinder is stationary. An even more important consideration than damage from moving objects is the cylinder tipping over, which will cause the valve to shear off.

Accordingly, it has heretofore been proposed to provide a protecting structure mounted on the neck of the cylinder adjacent to the valve, to shield the valve from impacts and blows to which the valve would otherwise be subjected. One widely used valve protecting structure is a cap threadedly mounted on a cylinder neck ring and almost completely enclosing the valve. Since the cap must be removed before a regulator and hose or other attachment can be connected to the valve, it does not protect the valve during the use of the cylinder. Moreover, in addition to being inconvenient, the necessity of removing the cap results in a high rate of loss of such caps with the attendant undesirable expense for replacement. Furthermore, when the cylinder is being transported by tipping and rolling it, the use of the conventional cap requires that the operator continually tighten the cap as the cylinder is being rolled in order to prevent the cap from unscrewing due to the clockwise rotation of the cylinder and the consequent counterclockwise rotation of the cap, if it is held stationary relative to the threads of the neck ring.

It has alternately been proposed to provide a protecting structure which is rotatably mounted on the cylinder neck and has one or more openings, both to enable access to the shielded valve and to adapt the protecting structure for use as a handle in carrying the cylinder. Since the valve customarily has a fitting that projects on one side for connection to a hose, regulator, or other attachment, and a hand wheel positioned at its outer extremity, a lateral access opening is provided in the protecting structure to enable connection of the regulator and hose or other attachment to the fitting, while the hand wheel is accessible through an enlarged end opening of the protecting structure.

Such an earlier proposed construction is disclosed in U.S. Pat. No. 3,006,360, issued on Oct. 31, 1961 to P. R. Oxenham. Although the Oxenham protecting structure is rotatably mounted on the neck of the cylinder, it has inherent disadvantages. Because it has a threaded locking collar which terminates well above the upper surface of the cylinder and because the area of the protecting structure in contact with the outer surface of the locking collar is so narrow, a ring must be welded to the collar to prevent the contacting portion of the protecting structure from sliding down below the collar and into engagement with the top of the cylinder. Moreover, the ring can only be welded on its lower side, which means that the welding process is costly and inefficient and that the attachment of the ring to the collar is intrinsically weak.

Furthermore, the narrow area of contact between the protecting element and the outer surface of the threaded collar makes the Oxenham protecting structure vulnerable to binding when an attempt is made to rotate it relative to the cylinder under any significant load. In addition, the thinness of the contacting portion of the protecting structure renders it susceptible to bending when subjected to substantial loads.

Moreover, the threaded locking collar of the Oxenham device is prevented from unthreading rotation merely by the interference of starting revolutions of thread on the locking collar with the starting revolutions of thread around the cylinder neck ring. Thus, the rotation of the protecting structure around the locking collar and the tendency of the protecting structure to bind with the locking collar can cause unthreading rotation of the locking collar on the threads around the cylinder neck and resultant loosening of the entire protecting device.

SUMMARY OF THE INVENTION

It is, therefore, an object of the present invention to provide a valve protector device which allows a secure handhold in order to facilitate the movement of a compressed gas cylinder when it is being rolled to and from cylinder filling lines.

It is another object of the present invention to provide a valve protector for a compressed gas cylinder which is rotatable relative to the cylinder despite heavy loading.

It is a further object of the present invention to provide a valve protector for a compressed gas cylinder which can easily be removed from one cylinder and placed on another.

It is a still further object of the present invention to provide a valve protector for a compressed cylinder which is firmly secured to the cylinder and is not subject to loosening.

It is yet another object of the present invention to provide a valve protector for a compressed gas cylinder which is adapted for engagement with the hook of a stationary-hook type wheeled carrier for compressed gas cylinders.

It is still another object of the present invention to provide a valve protector, which when mounted on a 200 lb. cylinder, is capable of protecting the valve of the cylinder from shearing off if the cylinder is tipped over from a truck dock, whether or not the cylinder has the regulator attached and connected for use.

Toward the fulfillment of these and other objects, the valve protector device of the present invention comprises a rigid, hollow, open-ended frustoconical valve protector having large lateral openings and an inwardly directed flange which includes two large orthogonal bearing surfaces in order to permit the valve protector to rotate freely with respect to the cylinder, even under heavy loading. A vertical bearing surface on an inner cylindrical wall of the flange engages a complementary vertical bearing surface on a locking collar, which has a radially outward extending flange overlapping the radially inwardly extending flange of the valve protector. Furthermore, a horizontal bearing surface on the top of the flange of the valve protector engages a complementary horizontal bearing surface on the bottom of the flange of the locking collar. Moreover, additional friction reducing measures may be taken to provide ease of rotation between the valve protector and the locking collar. For example, the valve protector may be formed of a ductile iron containing spheroidal graphite for lubrication purposes. In addition to these friction reducing measures, a self-lubricated washer may be positioned between the engaging horizontal surfaces of the overlapping flanges, thereby providing additional assurance of freedom of rotation.

Internal threads on the locking collar engage external threads on a neck ring which is secured to the cylinder around the cylinder neck. The lowermost several pitches of the thread of the locking collar are removed or relieved, thereby providing a thread relief so that the lower portion of the locking collar defines a downwardly directed sleeve having a rim which frictionally engages a shoulder of the cylinder and is bound against the shoulder by a force exerted by the coaction of the remaining threads on the locking collar with the threads on the neck ring. By securing the locking collar using frictional engagement of the sleeve with the shoulder of the cylinder, the locking collar is effectively locked in place and a fixed dimension is established between the outward extending flange of the locking collar and the shoulder of the cylinder. The fixed dimension defines the height of the vertical bearing surface, thereby providing a fixed vertical bearing area on which the valve protector element can rotate.

Consequently, access may be gained to the attachment connection or a valve handle by rotating the valve protector so that one of the openings is in alignment with the attachment or handle. Furthermore, the compressed gas cylinder to which the rotatable valve protector of the present invention is mounted can be moved by tilting the cylinder slightly so that only an edge of the cylinder base is in contact with the ground. Then, by grasping the side of the valve protector between the heel of the hand and the first joint of the fingers, the cylinder can be rolled by merely starting the rolling action by kicking the base of the cylinder with the foot. Two cylinders can be moved simultaneously by holding the valve protector of one cylinder in one hand and the valve protector of the second cylinder in the other hand and tipping the cylinders outward from the center in opposite directions, allowing the base of the first cylinder to contact the base of the second cylinder and by kicking the first cylinder in a clockwise direction to cause the second cylinder to roll in a counter-clockwise direction.

In an alternate embodiment of the invention, the neck ring includes a radially outward directed flange defining a shoulder. In this embodiment, the sleeve of the locking collar frictionally engages the neck ring shoulder instead of the cylinder shoulder. The neck ring shoulder also separates the valve protector from the cylinder shoulder and eliminates any tendency by the lower end of the valve protector to etch a groove in the cylinder shoulder.

The large areas of the bearing surfaces of the rotatable valve protector and the interposition of the self-lubricating ring preserve the free rotation of the valve protector on the cylinder despite the heavy, angularly oriented loads applied to the bearing surfaces during the tilt rolling of the cylinder.

One of the large lateral openings is adapted to receive a hook of a stationary hook type wheeled carrier for compressed gas cylinders, such as that described in Ser. No. 904,803.

DETAILED DESCRIPTION OF THE PREFERRED EMBODIMENT

Figure 1:
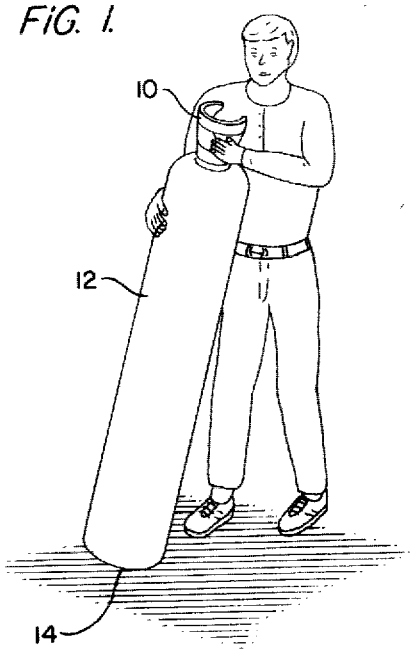
FIG. 1 is a perspective view of a compressed gas cylinder, with the rotatable valve protector of the present invention mounted thereon, in position for rolling along a supporting surface.

In FIG. 1, the reference numeral 10 generally designates the rotatable valve protector according to the present invention mounted on a conventional compressed gas cylinder 12. The cylinder 12 typically includes a flat circular bottom 14 so that the cylinder is self-standing. The rotatability of the valve protector 10 and the circular bottom 14 allow a user to tilt and support the cylinder 12 at one end by grasping the valve protector with one hand, as shown, and to frictionally impart a rolling force to the cylinder 12 with the other hand so that the circular bottom 14 rolls along a supporting surface.

Figure 2:
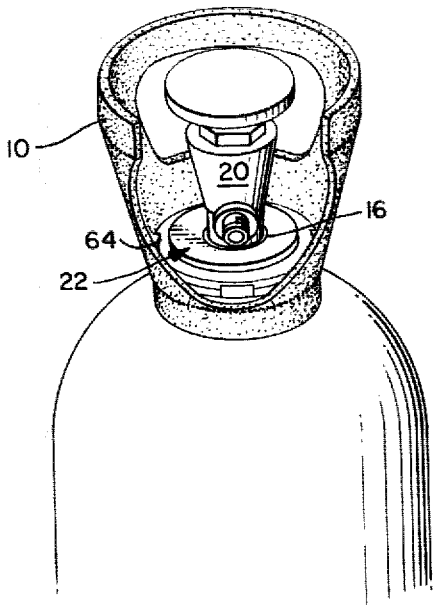
FIG. 2 is an enlarged front perspective view of the rotatable valve protector and the neck of the cylinder of FIG. 1.

As shown in FIG. 2, the cylinder 12 has a neck 16 in which a valve 20 is threadedly secured. The valve protector 10 is secured relative to the cylinder 12 by an assembly 22 which extends around the neck 16 and which will also be described in detail later.

Figure 3:
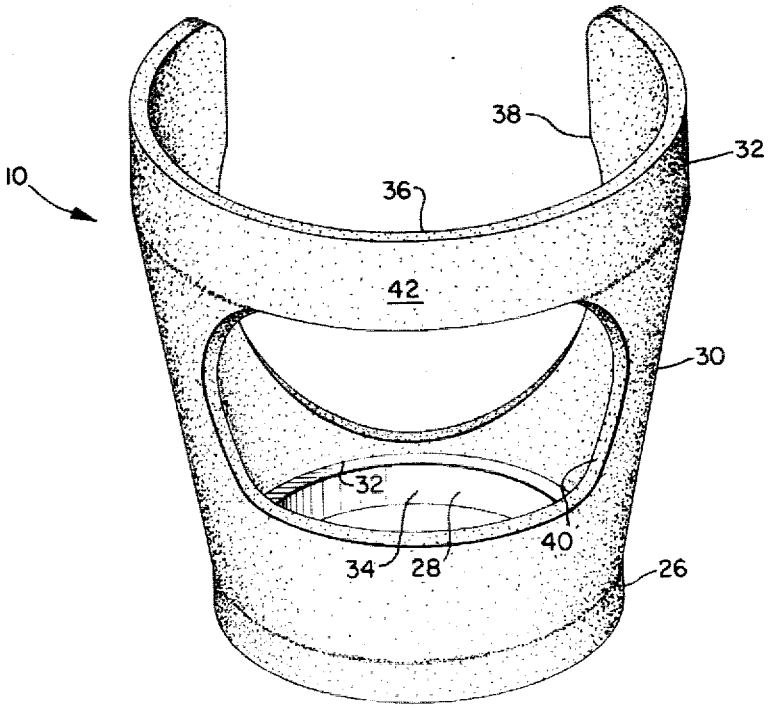
FIG. 3 is an enlarged rear perspective view of the rotatable valve protector of FIG. 1.

Referring to FIG. 3, the valve protector 10 is a generally rigid, unitary, integrally formed open-ended structure and includes a lower cylindrical section 26 having a radially inward directed flange 28, a frustoconical outward flaring central section 30, and an upper cylindrical section 32. The flange 28 defines an upper bearing surface 32 as viewed in FIG. 3 and cylindrical vertical bearing surface 34 having an axial dimension substantially equal to the height of the lower cylindrical section 26 and an internal diameter slightly greater than the external diameter of the mounting assembly 22. The upper cylindrical section 32 is coaxial with the lower and central sections 26 and 30, respectively, and terminates in a rim 36 lying in a plane normal to the axis of the valve protector 10. The valve protector 10 is rigid and of sufficient thickness and strength to support the weight of the cylinder 12 and to shield the valve 20 effectively against blows or impacts.

A large lateral U-shaped opening 38 is formed in one side of the central frustoconical section 30 and the upper cylindrical section 32 and extends upwardly through the rim 36. A lateral bridged opening 40 is formed in the central frustoconical section 30 in a diametrically opposed relation to the U-shaped opening 38, and is bridged by a handle portion 42 defined by a length of the upper cylindrical section 32. Additional openings may also be made in the central frustoconical section 30 for use, for example, with valves having "side-reading" built-in gauges.

Figure 4:
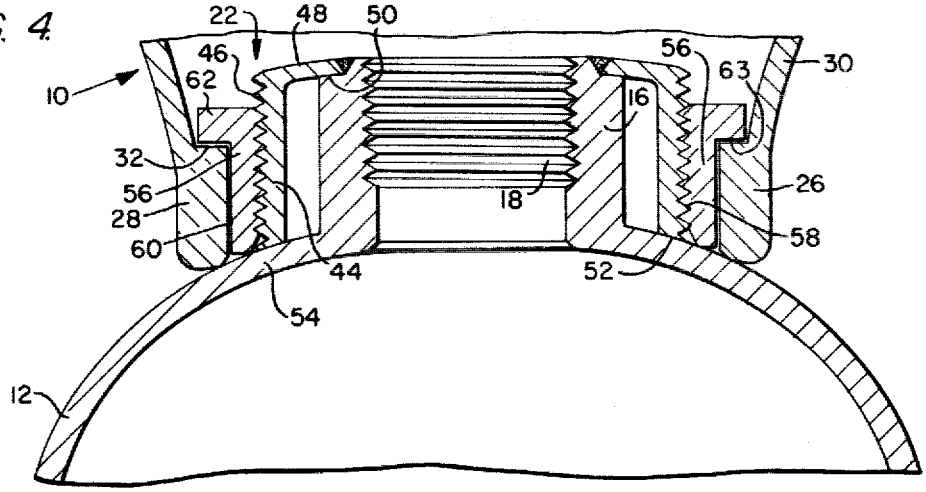
FIG. 4 is a vertical cross-sectional view of the rotatable valve protector and the neck of the cylinder of FIG. 2.

The assembly 22 for securing the valve protector 10 to the neck 16 of the cylinder 12 is better shown in FIG. 4 and includes a neck ring 44 extending around the neck 16 and having a plurality of threads 46 formed on its outer surface. A radially inwardly extending flange 48 is formed on the neck ring 44 and is received in a shallow annular groove 50 in the top of the cylinder neck 16, while a lower end 52 of the neck ring 44 is secured, by welding or the like, to a shoulder 54 of the cylinder 12, at a radial distance from the neck 16.

A locking collar 56 is disposed between the neck ring 44 and the valve protector 10 to secure the protector relative to the neck 16 in a freely rotatable mode. The locking collar 56 is ring-shaped, has an axial dimension substantially slightly less than the axial dimension of the neck ring 44, and includes internal threads 58 for mating with the external threads 46 of the neck ring. The locking collar 56 includes a smooth outer vertical bearing surface 60 in engagement with, and having substantially the same area as, the vertical bearing surface 34 on the flange 28 of the valve protector 10. A radially outwardly directed flange 62 extends from the upper end of the locking collar 56 and includes a lower horizontal bearing surface 63 for abutment with the upper horizontal bearing surface 32 on the flange 28 of the valve protector 10. The flange 62 includes a plurality of notches 64 (FIG. 2) to receive a tool for tightening and loosening the locking collar 56. Thus, the locking collar 56 and the flange 28 of the valve protector 10 are in engagement along two different bearing surfaces to provide substantial bearing strength. Moreover, the machining of the valve protector and the locking collar can be done with precision, with tolerances held to ±0.005" in order to insure that the valve protector does not lock and create a binding condition when the cylinder is tipped for rolling.

The cooperation between the valve protector 10 and the locking collar 56 to provide a rotatable mounting of the valve protector 10 on the cylinder 12 permits the use of various size locking collars 56 to cooperate with a single size valve protector 10. The standard thread sizes for high pressure cylinders are 3.125"/11, 3.125"/7, and 3.150"/11. Thus, different locking collars 56 having thread sizes corresponding to the standard thread sizes on the high pressure cylinders can be employed so that a single size valve protector 10 can be mounted to high pressure cylinders having various thread sizes. For acetylene cylinders, the standard thread sizes are 3.50"/7 and 3.50"/11. A second, larger valve protector 10 can be provided for the acetylene cylinders, and locking collars 56 having the different thread sizes can be used to mount the larger valve protector 10 on acetylene cylinders having each of the standard thread sizes.

Various friction reducing measures may be taken to provide ease of rotation between the valve protector 10 and the locking collar 56. For example, the bearing surfaces on the locking collar 56 can be plated with a material, such as zinc, to provide hard smooth surfaces on which the bearing surfaces of the valve protector 10 can slide. In the alternative, the bearing surfaces of the locking collar 56 can be coated with nylon or other low friction materials. Moreover, a dry lubricating material such as graphite, molybdenum disulfide, talc or boron nitride can be applied to all of the bearing surfaces. Additional bearing materials which could be employed are metal sprayed lubricants or dip metal lubricants, such as lead or tin, which could be dipped or plated on. Alternatively, a thin, e.g., 0.030" to 0.040", bearing sleeve of a material such as powdered metal, bronze, aluminum tin, or tin could be used.

The valve protector 10 can be fabricated from a ductile iron having a small amount of added magnesium. The iron has a microstructure of spheroidal graphite in a steel matrix. Thus, the valve protector 10, upon machining, presents a bearing surface lubricated by its own spheroidal graphite and having a porosity suitable for receiving and holding dry lubricants.

Figure 5:
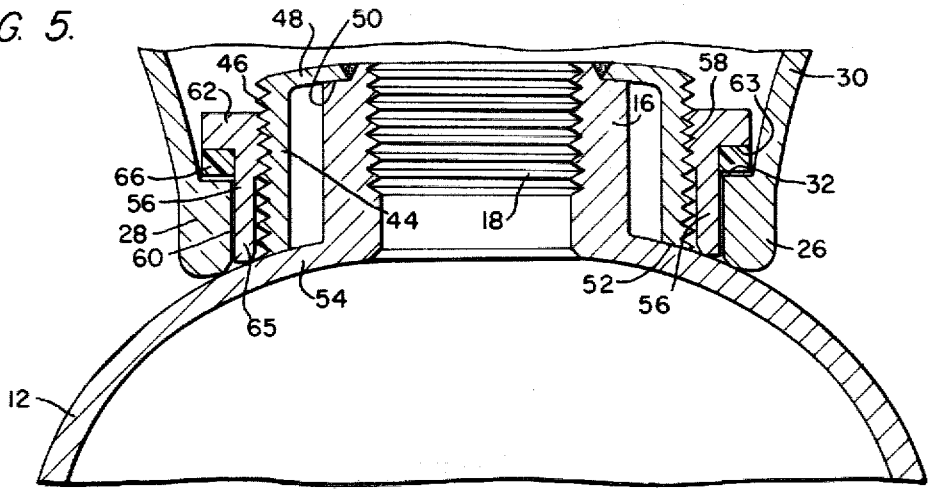
FIG. 5 is a view similar to FIG. 4 and depicting an alternate embodiment of the rotatable valve protector according to the present invention.

In the embodiment illustrated in FIG. 5, several pitches of the threads 58 have been eliminated from the lower portion of the locking collar 56 to enable quicker positioning or removal of the locking collar. When these threads are eliminated, the locking collar 56 defines a downwardly directed sleeve 65 having a rim which frictionally engages the shoulder 54 of the cylinder 12 and is bound against the shoulder by a force exerted by the coaction of the remaining threads 58 on the locking collar 56 with the threads 46 on the neck ring 44. Thus, by screwing the locking collar 56 on to the neck ring 24 with the tool engaging the notches 64, a relatively high axial force can be transmitted to the sleeve 65 to frictionally lock the sleeve 65 against the shoulder 54 of the cylinder 12.

Figure 6:
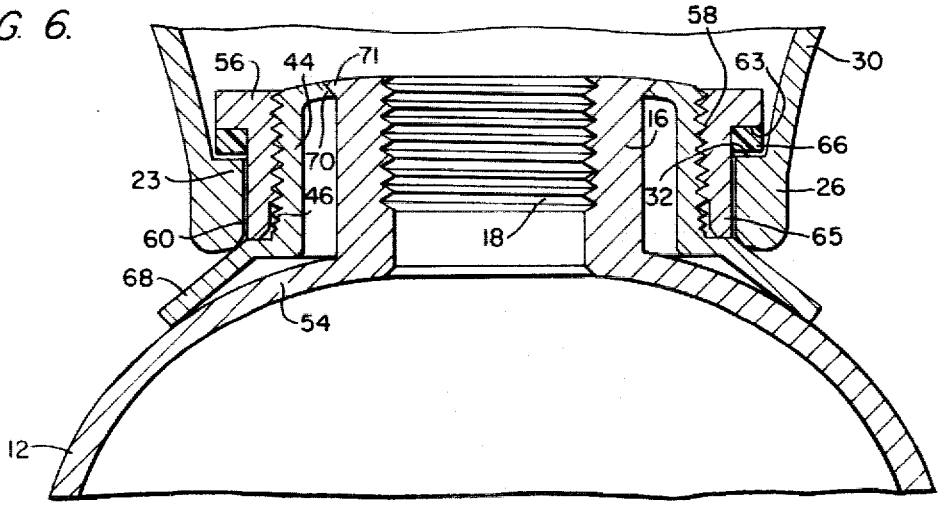
FIG. 6 is a view similar to FIG. 4 and depicting a further embodiment of the rotatable valve protector according to the present invention.

FIG. 6 discloses still another embodiment of the invention, which is similar to the embodiment of FIG. 5 except that a shoulder 68 is provided integrally with the neck ring 44 and flares radially outward and downward from its lower end. The shoulder 68 absorbs the forces imparted by the lower end of the valve protector 10 and eliminates any tendency by the lower end of the valve protector 10 to etch a groove in the shoulder 54 of the cylinder 12. Moreover, the large periphery of the shoulder 68 enables even stronger attachment of the neck ring 24 to the cylinder 12. The radially inwardly extending flange 48 terminates in an annular bevelled edge 70 which is engaged by an outwardly extending rim 71 on the top of the neck 16. In assembling the valve protector 10 on the cylinder 12, the neck ring 44 is placed over the neck 16, and the rim 71 is peened outwardly onto the flange 48 to fix the neck ring 44 in place on the cylinder 12.

In contrast, were the threads 58 to extend all the way to the bottom of the locking collar 56 no downwardly directed sleeve would be defined, and the locking collar 56 would be secured against unthreading rotation on the neck ring 44 merely by the frictional engagement of the lower several pitches of the threads 58 binding with the lower incomplete pitches of the threads 46 of the neck ring 44 where the neck ring 44 abuts the shoulder 54 of the cylinder 12. The lower pitches of the threads 46 are incomplete and the grooves are not at full depth because the first two to three threads of the chaser die which cuts the threads 46 into the neck ring 44 require a lead-in and have an increased diameter in order to allow the die to start.

Furthermore, the axial dimension of the radially inwardly directed flange 28 of the protector 10 is reduced and a bearing ring 66 of self-lubricated material, such as polytetrafluoroethylene, sold under the tradename Teflon, or nylon, is positioned between the horizontal bearing surfaces 63 and 32 of the locking collar 56 and the flange 28, respectively. The bearing ring may be either homogeneous or impregnated with lubricants. The addition of the bearing ring 66 provides additional assurance of free rotation of the valve protector 10 and eliminates virtually any possibility of binding between the valve protector and the locking collar 56 when there is rotation between the two elements under load.

Figure 7:
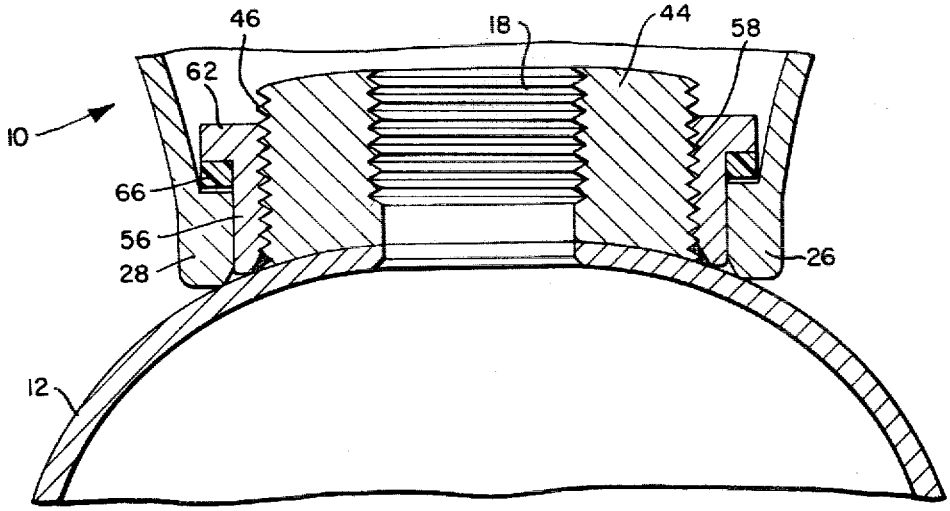
FIG. 7 is an enlarged front perspective view of the rotatable valve protector mounted on a compressed gas cylinder having a welded neck ring.

In another embodiment of the present invention, as illustrated in FIG. 7, the valve protector 10 is mounted on a neck ring 44 which is welded to the compressed gas cylinder 12. This embodiment is especially adapted for use with acetylene cylinders, which are formed from a drawn shell which does not have adequate material to form the neck and, therefore, require a forged neck ring 44 which is welded in place on the drawn shell. The neck ring 44 includes both internal threads to accept the valve 20 and external threads 46 to receive the internally-threaded locking collar 56. In other respects, the embodiment of FIG. 7 is similar to the embodiment of FIG. 5.

Figure 8:
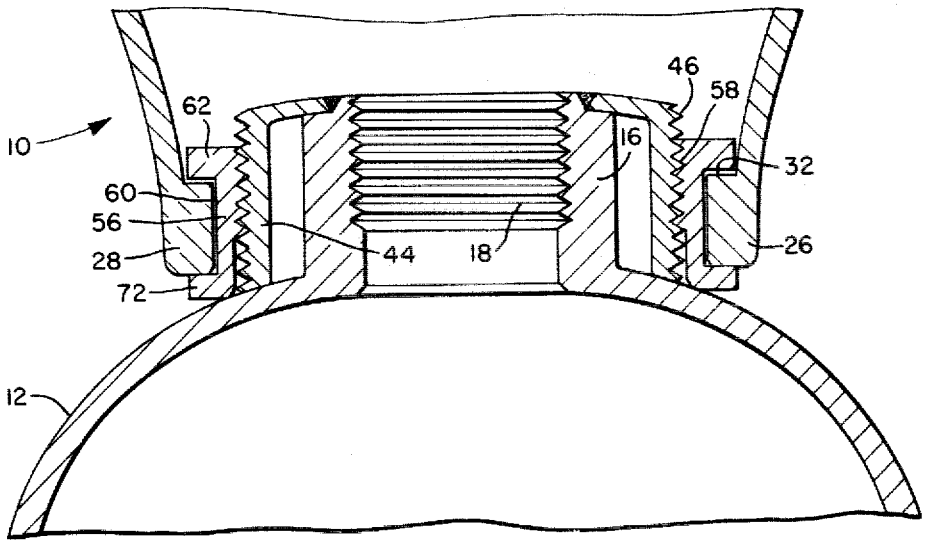
FIG. 8 is a view similar to FIG. 4 and depicting still another embodiment of the rotatable valve protector according to the present invention.

Yet another embodiment of the present invention, as illustrated in FIG. 8, employs a unitized locking collar 56 and valve protector 10. The locking collar 56 is extended at its lower end to include a radially outwardly extending annular flange 72 which is coined back against the base of the valve protector 10, so as to allow clearance on both the top and bottom of the flange 28 of the valve protector 10. The unitized arrangement of the embodiment of FIG. 8 is obtained by placing the locking collar 56 in the valve protector 10 and inverting it in a press-forming operation whereby a downward-stroking punch flares the base of the locking collar 56, totally capturing the flange 28 of the valve protector 10.

As discussed above in connection with FIG. 2, the cylinder valve 20 is threaded into, and projects from, the neck 14 and is laterally shielded by the valve protector 10, while access to the valve 20 is provided through the opening 38 in the valve protector 10, as well as through the outer end opening of the protector. The valve 20 may be installed after the valve protector 10 is in place, since there is no need to provide initial alignment of the lateral outlet fitting of the valve 20 with the U-shaped opening 48 of the valve protector 10. After the valve 20 is installed, the valve protector 10 can simply be turned about its axis until the U-shaped opening 38 is aligned with an outlet fitting associated with the valve 20. A hose, pressure line, regulator or other attachment may then be readily connected to the outlet fitting through the U-shaped opening 48, without interference by the valve protector 10. The dimensions of the valve protector 10, its upper end opening, and the U-shaped opening 48 are selected to accommodate the valve 20 and any tools with a clearance necessary for the connection or adjustment of an attachment to the valve 20. Of course, a handwheel or the like (not shown), on the valve 20 is accessible for manual adjustment through the upper end opening of the valve protector 10.

The bridged opening 40 of the protector 10 is shaped to permit insertion of a human hand for gripping the handle portion 42, thereby enabling use of the valve protector 10 as a handle in lifting or dragging the cylinder 12 to which it is attached. The opening 40 is also well suited for receiving the hook of a stationary-hook type wheeled carrier for compressed gas cylinders, such as the carrier disclosed in aforesaid copending application Ser. No. 904,803 and U.S. Pat. No. 4,098,416. The opening 40 is also suitable for receiving a hook mounted on a wall or rack for holding the cylinder 12 stationary in storage or at the point of use. Furthermore, since the rim 36 of the valve protector 10 is disposed in coaxial relation to the compressed gas cylinder 12 and in a plane perpendicular to the axis of the cylinder 12, the valve protector 10 can be used as a base for supporting the cylinder 12 in an inverted standing position.

For rolling the cylinder 12, the valve protector 10 is gripped on the side, along the frustoconical central section 30 and tipped at a slight angle from the vertical so that only one point on the circumference of the flat circular bottom 14 of the cylinder 12 is in engagement with the supporting surface. The lower edge of the bridged opening 40 is positioned above the level of a pressure relief valve (not shown), which protrudes from the side of the valve 20, thereby preventing the fingers of the operator from extending through the valve protector 10 in an area where they may be struck by the protruding discharge valve as the cylinder 12 rotates within the valve protector 10. Then, while the valve protector 10 is held in one hand, the free hand of the mover can be used to frictionally apply a torque to the cylinder 12 somewhere along its surface, thereby rolling the cylinder 12 along the supporting surface.

Although it is apparent from the foregoing that the present invention is well adapted for application to compressed gas cylinders, it is understood that the scope of the present invention is not so limited, but rather extends to other protector and handle applications. Also, various other changes and modifications may be made without departing from the spirit and scope of the present invention as recited in the appended claims and their legal equivalent.

What is claimed is:

1. A device for protecting a valve mounted in a neck of a compressed gas cylinder and for serving as a handle for the cylinder, comprising:

a neck ring affixed to the cylinder in concentric relationship with the neck of the cylinder, said neck ring having external threads;

a hollow valve protector having open ends, a lateral opening between the open ends, and an annular inwardly directed flange at one open end, said flange having mutually orthogonal bearing surfaces; and a locking collar having internal threads mating with the external threads of the neck ring and an outwardly directed flange overlapping the inwardly directed flange of the valve protector, the locking collar having a vertical bearing surface and the outwardly directed flange having a horizontal bearing surface which engage the mutually orthogonal bearing surfaces of the valve protector, the locking collar further including a sleeve extending beyond the internal threads of the locking collar in the direction of the cylinder for frictional engagement with the cylinder, whereby the valve protector is freely rotatable around the neck of the cylinder, even under heavy loading.

2. The device according to claim 1, wherein a coating of low-friction material is bonded to the bearing surfaces of the locking collar.

3. The device according to claim 1, wherein a bearing ring of self-lubricated material is interposed between the overlapping flanges of the locking ring and valve protector.

4. The device of claim 1 wherein the vertical bearing surface of the locking collar and the bearing surface of the valve protector which the vertical bearing surface of the locking collar engages have areas which are substantially equal.

5. The device of claim 1 wherein the locking collar includes a lower unitary outwardly directed flange defined at the lower end of the locking collar and overlapping the inwardly directed flange of the valve protector, whereby the valve protector is retained on the locking collar.

6. A device for protecting a valve mounted in a neck of a compressed gas cylinder and for serving as a handle for the cylinder, comprising:

a neck ring affixed to the cylinder in concentric relationship with the neck of the cylinder, said neck ring having external threads;

a hollow valve protector having open ends, a lateral opening between the open ends, and an annular inwardly directed flange at one open end, said flange having mutually orthogonal bearing surfaces; and a locking collar having internal threads mating with the external threads of the neck ring and an outwardly directed flange overlapping the inwardly directed flange of the valve protector, the locking collar having a vertical bearing surface and the outwardly directed flange having a horizontal bearing surface which engage the mutually orthogonal bearing surfaces of the valve protector, the valve protector being formed from a ductile iron having a microstructure of spheroidal graphite in a steel matrix, whereby the bearing surfaces of the valve protector element are lubricated by their own self-contained graphite and the valve protector is freely rotatable around the neck of the cylinder, even under heavy loading.

7. A device for protecting a valve mounted in a neck of a compressed gas cylinder having a shoulder and for serving as a handle for the cylinder, comprising:

a neck ring affixed to the cylinder in concentric relationship with the neck of the cylinder, said neck ring having external threads and an annular shoulder extending outwardly adjacent to the shoulder of the cylinder;

a hollow valve protector having open ends, a lateral opening between the open ends, and an annular inwardly directed flange at one open end, said flange having mutually orthogonal bearing surfaces; and a locking collar having internal threads mating with the external threads of the neck ring and an outwardly directed flange overlapping the inwardly directed flange of the valve protector, the locking collar having a vertical bearing surface and the outwardly directed flange having a horizontal bearing surface which engage the mutually orthogonal bearing surfaces of the valve protector, whereby the valve protector is freely rotatable around the neck of the cylinder, even under heavy loading, and the neck ring shoulder shields the cylinder shoulder from the valve protector and eliminates any tendency of the valve protector to etch a groove in the cylinder upon rotation of the valve protector.

8. The device of claim 7 wherein the neck ring includes a sleeve extending beyond the internal threads of the locking collar in the direction of the cylinder, said sleeve frictionally engaging the shoulder of the neck ring.

9. The device of claim 7 wherein a coating of low-friction material is bonded to the bearing surfaces of the locking collar.

10. The device of claim 7 wherein a bearing ring of self-lubricated material is interposed between the overlapping flanges of the locking ring and valve protector.

* * * * *